US005415065A

United States Patent [19]

McMills

[11] Patent Number: 5,415,065

[45] Date of Patent: May 16, 1995

[54] HAND TOOL WITH TORQUE SLEEVE FOR LIMITING INSTALLATION TORQUE

[76] Inventor: Corey J. McMills, 721 Distel Dr., Los Altos, Calif. 94022

[21] Appl. No.: 184,937

[22] Filed: Jan. 24, 1994

Related U.S. Application Data

[63] Continuation of Ser. No. 892,131, Jun. 2, 1992, abandoned.

[51] Int. Cl.[6] ..... B25B 23/14

[52] U.S. Cl. ..... 81/467; 81/124.2

[58] Field of Search ..... 81/467, 472, 477, 480, 81/124.2, 120, 185

[56] References Cited

U.S. PATENT DOCUMENTS 4,724,731 2/1988 Onofrio ..... 81/124.2 X
4,880,245 11/1989 Autrey ..... 81/120 X
5,165,310 11/1992 Heinrich ..... 81/120

*Primary Examiner*—D. S. Meislin
*Attorney, Agent, or Firm*—Paul Hentzel

[57] ABSTRACT

A hand tool formed by a body member 10B and a torque sleeve member 12S is employed to tighten a connector nut 14N at the end of an electrical cable 14C onto a cable terminal post 14P. The body is elongated having a long axis with a socket wrench 10W at one end and a handle 10H at the other end. A cable channel 10C extends along the long axis from the wrench end to the handle end for receiving the cable during installation. The inside surface of the wrench has side walls 10SW for capturing the connector nut. The outside surface of the wrench has a slight taper toward the wrench end of the body, and the inside surface of the sleeve has a generally matching taper. The sleeve is slide mounted over the wrench and the connector nut for establishing a pre-load hoop tension in the sleeve against the wrench which establishes a pre-load compression in the wrench against the connector nut. The engagement of the matching tapered surfaces causes the pre-load hoop tension to increase as the sleeve is slid over the wrench. The tapered surface engagement produces a working load hoop tension in the sleeve as the nut is tightened against the terminal post, which produces a working load compression in the wrench against the nut. The working load hoop tension has a critical value above which the tensile expansion of the sleeve permits the side walls of the wrench to slip around the nut for limiting the torque of the nut against the terminal post.

15 Claims, 4 Drawing Sheets

HAND TOOL WITH TORQUE SLEEVE FOR LIMITING INSTALLATION TORQUE

This is a continuation of application Ser. No. 07/892,131, filed 2 Jun. 92, (abandoned)

TECHNICAL FIELD

This invention relates to a hand tool with a torque sleeve for installing an electrical cable onto a terminal post.

BACKGROUND

Heretofore electrical cables have been installed by turning the connector nut by hand without the use of tools. This by hand procedure was convenient and fast, however the "finger tight" nut-to-post engagement was typically 2–5 inch-pounds resulting in water leakage and high impedance contacts. A torque of 30–60 inch-pounds is recommended by many connector manufacturers. Open end wrenches were employed to obtain a tighter connection. Post access with this bulky tool was difficult, and the connection was sometimes over-tightened resulting in damage to the post.

SUMMARY

It is therefore an object of this invention to provide an improved hand tool for installing electrical cable.

It is another object of this invention to provide such a hand tool which automatically limits the nut-to-post torque.

It is a further object of this invention to provide such a hand tool which provides a uniform torque.

It is a further object of this invention to provide such a hand tool having a torque sleeve which is installed on the terminal post along with electrical cable.

It is a further object of this invention to provide such a hand tool in which the installed torque sleeve is a "witness" to the installation torque.

It is a further object of this invention to provide such a hand tool in which the color of the installed torque sleeve indicates the destination of the cable.

It is a further object of this invention to provide such a hand tool in which the installed torque sleeve is a tamper barrier and environmental shield.

It is a further object of this invention to provide such a hand tool in which the installed torque sleeve is forms a seal over the nut-to-post engagement.

Briefly, these and other objects of the present invention are accomplished by providing a hand tool for tightening a connector nut at the end of an electrical cable in order to install the cable onto a cable terminal post. The hand tool has an elongated body member having a long axis with a first end and a second end. A cable channel is formed in the body member extending along the long axis thereof from the first end to the second end. The cable channel receives the cable prior to the installation the cable and permits the body member to turn relative to the cable during the installation of the cable and permits removal of the cable from the hand tool after the cable has been installed. A socket wrench is formed at the first end of the body member having an outside surface and an inside surface. The inside surface of the socket wrench has a side wall for capturing the connector nut at the end of the electrical cable. The side wall has a gap therein formed by the cable channel. A handle is formed at the second end of the body member for turning the wrench and the connector nut captured therein without turning the cable, in order to thread the connector nut onto the terminal post and to tighten the connector nut against the terminal post. A sleeve member having an outside surface and an inside surface is slide mounted over the wrench and the connector nut from the first end of the body member after the cable channel has received the cable and after the wrench has captured the connector nut. The inside surface of the sleeve member engages the outside surface of the wrench for establishing a pre-load hoop tension in the sleeve member against the wrench which establishes a pre-load compression in the wrench against the connector nut.

BRIEF DESCRIPTION OF THE DRAWING

Further objects and advantages of the present hand tool and cable installation will become apparent from the following detailed description and drawing (not drawn to scale) in which.

Figure 1:
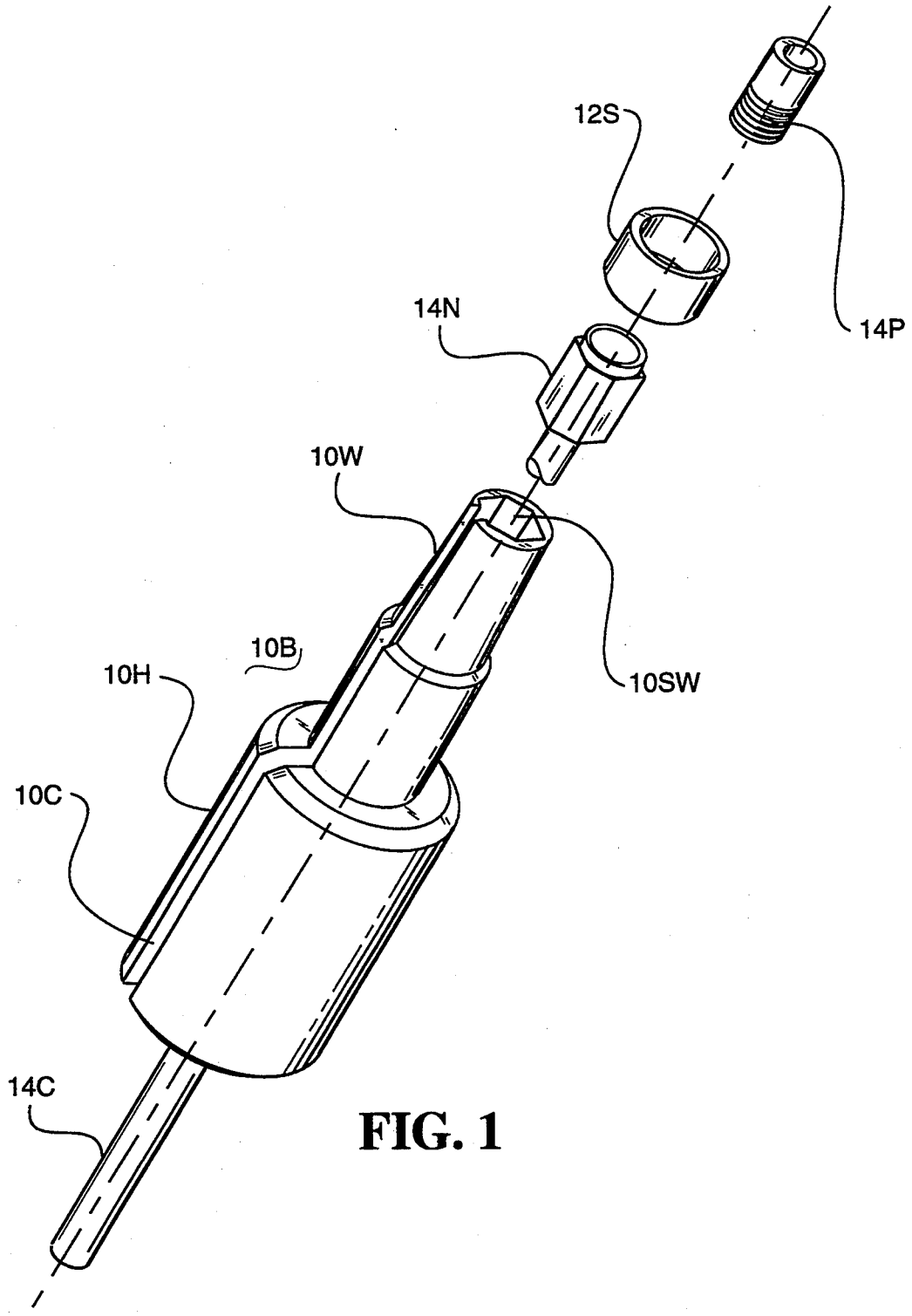
FIG. 1 is a perspective view of a hand tool showing the cable to be installed placed within a cable channel formed along the hand tool.

The elements of the invention are designated by two digit reference numerals in the above Figures, The first digit indicates the Figure in which that element is first disclosed or is primarily described, The second digit indicates related features and structures throughout the Figures, Some reference numerals are followed by a letter which indicates a sub-portion or feature of that element.

GENERAL DESCRIPTION (FIG. 1)

A hand tool formed by a body member 10B and a torque sleeve member 12S is employed to tighten a connector nut 14N at the end of an electrical cable 14C onto a cable terminal post 14P. The body is elongated having a long axis with a socket wrench 10W at one end and a handle 10H at the other end. A cable channel 10C extends along the long axis from the wrench end to the handle end for receiving the cable during installation. The inside surface of the wrench has side walls 10SW for capturing the connector nut. The outside surface of the wrench has a slight taper toward the wrench end of the body, and the inside surface of the sleeve has a generally matching taper. The sleeve is formed of a rigid material and is slide mounted over the wrench and the connector nut for establishing a pre-load hoop tension in the sleeve against the wrench which establishes a pre-load compression in the wrench against the connector nut. The engagement of the matching tapered surfaces causes the pre-load hoop tension to increase as the sleeve is slid over the wrench. The tapered surface engagement produces a working load hoop tension in the sleeve as the nut is tightened against the terminal post, which produces a working load compression in the wrench against the nut. The working load hoop tension has a critical value above which the tensile expansion of the sleeve permits the side walls of the wrench to slip around the nut for limiting the torque of the nut against the terminal post.

CABLE INSTALLATION (FIG. 2A–2E)

Figure 2A:
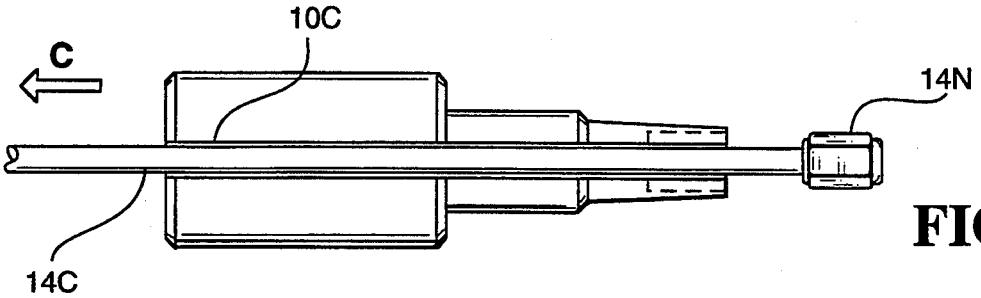
FIG. 2A shows a hand tool and cable prior to installation.

Prior to the installation, cable 14C is placed within cable channel 10C (see FIG. 2A). The cable channel is contains the long axis of elongated body member 10B for permitting the body and connector nut 14N to turn relative to the cable during the installation and torquing (see FIG. 2D), and for removing the cable from the hand tool after the cable has been installed (see FIG. 2E).

Figure 2B:
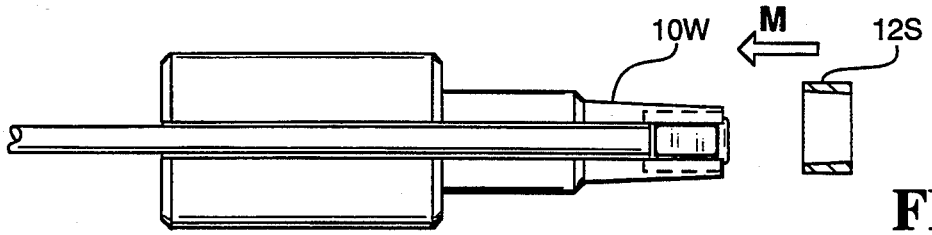
FIG. 2B shows a hand tool and cable with the cable connector nut captured by a socket wrench formed at the FIG. 2C shows a hand tool and cable with a torque sleeve mounted over the socket wrench.

After placement, the cable is pulled from the handle end (or pushed from the connector end) as indicated by arrow C causing the nut to enter socket wrench 10W (see FIG. 2B). Preferably, the side walls of the wrench are longer than the corresponding faces of the connector nut, and form a socket deep enough to capture the entire length of the nut. This full capture distributes the working load during torquing of the nut, and minimizes the shear stress within the nut and the side walls of the wrench. The wrench and the sleeve may be slightly cone shaped for providing the matched tapers, and have a common central axis when engaged which is coincident with the long axis of the body member. The cone shape may be formed by compression molding, injection molding, or hot formed from cylindrical stock.

Figure 3:
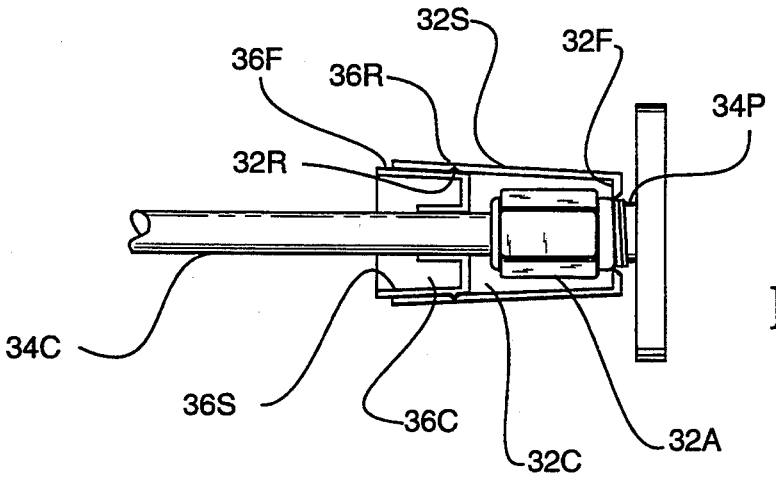
FIG. 3 is a sectional view of a torque sleeve and front closure member forming a sleeve chamber.

Sleeve member 12S is slide mounted onto the hand tool as indicated by arrow M, until the tapered outside surface of socket wrench 10W engages the tapered inside surface of the sleeve (see FIG. 3C). The range of outside diameters along the taper of the wrench is slightly greater than the range of inside diameters along the taper of the sleeve, which establishes the pre-load hoop tension in the sleeve and the pre-load compression in the wrench. The pre-load is sufficient to cause the side walls of the wrench to fit snugly against the connector nut (preferably at zero clearance) for capturing the connector nut.

The slope of the matching tapers is high enough to provide the desired pre-load hoop tension in the sleeve when the sleeve mounted, and low enough to maintain static frictional engagement between the inside surface of the sleeve and the outside surface of the wrench. The taper slope is the defined by the relationship:

Taper Slope = Tangent (A)

where

A is the angle of each matched tapered surface relative to the center of the torque sleeve.

The taper angle A may be between from about 0.5 degrees to about 5.0 degrees, forming a total taper angle $2 \times A$ of from about 1.0 degrees to about 10 degrees. The total taper angle is the angle of the apex of the cone forming the taper which is twice the angle of the taper slope of one the side of the cone. A preferred taper angle A of about 2 degrees forms a total taper angle $2 \times A$ of about 4 degrees.

Figure 2C:
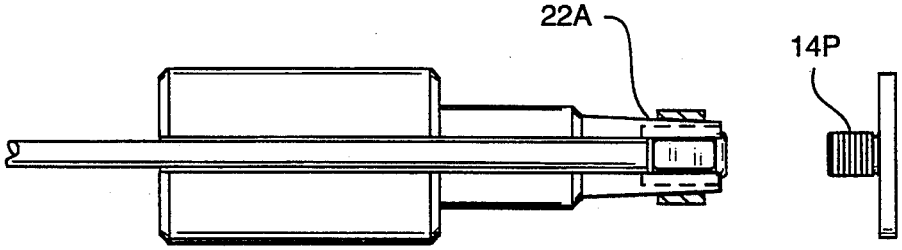
FIG. 2D shows a hand tool and cable with the cable connector nut being torqued against a terminal post.
FIG. 2E shows a cable, torque sleeve and terminal post after installation.
Figure 2D:
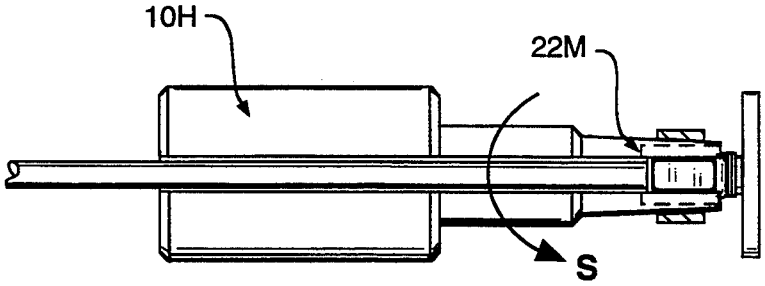
Figure 2E:
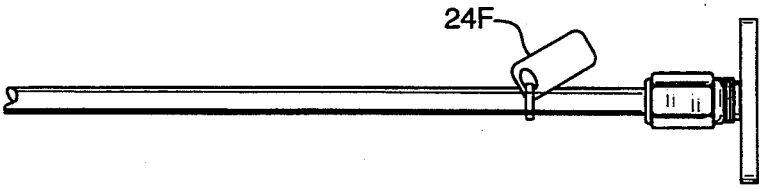

The outside surface of the wrench may have a suitable stop structure thereon which defines the maximum pre-load hoop tension established within the sleeve by limiting the slide mounting of the sleeve. The stop structure may be a shoulder such as annual rise 22A (see FIG. 2C) extending around the wrench proximate the bottom of the socket wrench. As the torque sleeve is slide mounted onto the wrench, the engagement of the tapered surfaces establish the pre-load within the sleeve and the wrench. Tight tapered engagements, establish high pre-loads. When the front edge of the torque sleeve contacts the stop shoulder, the slide mounting cannot proceed further. The pre-load is fixed by the position of the stop shoulder.

After the nut is captured within the socket wrench and the sleeve mounted thereover, the nut is threaded onto terminal post 14P. The post has external threads for engaging the internal threads of the connector nut. The engagement of the threads can be felt by the user through handle 10H. The working load develops as the nut approaches full engagement with the terminal post (see FIG. 2D). At full engagement, the working load reaches the critical value. and the tensile expansion of the sleeve permits the wrench to slip around the nut as indicated by arrow S.

The value of the critical working load within the sleeve is determined by the length, thickness and diameter of the sleeve; and by the mechanical characteristics of the material forming the sleeve, particularly the modulas of elasticity (Young's modulas). Most applications require a critical working load which provides a nut-to-post torque of from about 2 inch-pounds to about 120 inch-pounds The side walls along the inside surface of the wrench may have a suitable reinforcing structure such as an abrasion resistant metal insert 20M (see FIG. 2D) to minimize slippage wear or rounding of the side walls against the nut. The insert may be compression molded into the wrench during the formation of the hand tool, or press fitted into position after the molding process.

After torquing, the hand tool is dismounted from the sleeve and removed from around the cable, leaving the sleeve strung permanently on the cable as a protective shield over the terminal post; and as a "witness" to the proper torque of the nut against the terminal post. The presence of the sleeve shields the nut-to-post engagement from the elements and foreign material. The sleeve also hinders access to the connector nut forming a tamper barrier against "signal theft". Normally, only the cable service man will have hand tool 10B (or other suitable device) for removing the connector and sleeve.

A suitable strain relief mechanism such as pole fastener 24F may be employed which retains the sleeve in position proximate the terminal post. The terminal posts units on utility poles carrying the cable typically have multiple posts, one for each near by residence. If desired, the color of the sleeve may be selected from a set of colors with matching colored sleeves installed on the terminal posts of the near by residences.

SLEEVE CHAMBER EMBODIMENTS (FIG. 3)

A rear closure flange 32F (see FIG. 3) may be provided at the small end of the torque sleeve 32S defining a post aperture 32A for receiving the terminal post 34P as the torque sleeve is installed. The post aperture has a diameter less than the diameter of the connector nut and is retained on the terminal post by the connector nut. In one embodiment, the torque sleeve may be turned in position between the connector nut and the terminal post without disturbing the nut-to-post engagement. This free turning enhances the tamper barrier feature of the sleeve. Alternatively, the diameter of the post aperture may be slightly less than the diameter of the terminal post for creating a rear seal along the interface therebetween.

A front closure member 36F may be provided which seats into the large end of the torque sleeve after the sleeve and cable have been installed. The front closure member has a cable passage 36P therethrough for permitting cable 34C to pass into the torque sleeve. The front closure member may be tapered to generally match the taper of the inner surface of the torque sleeve.

The body member of the hand tool may be employed to assist in pushing the front closure member into the torque sleeve in order to facilitate seating of the front closure member. A recess with a side flange 36S may be provided in the front surface of the front closure member for engaging and guiding the tip of the wrench end of the body member.

A raised retaining rib 36R may be provided on the outside surface of the front closure member which engages a corresponding retaining groove 32R on the inside surface of the torque sleeve as the closure member is seated. The cooperating rib and groove structure snap into engagement for retaining the front closure member in position after seating. The rib may have a "ramped" leading edge to facilitate pushing the front closure member into the sleeve, and a steep tailing edge to prevent easy removal of the rib from the groove. The rib and groove also provide a front seal along the interface between the front closure member and the torque sleeve. A suitable cable seal may be provided structure such as cable collar 36C extending from the front surface of the front closure member. The cable collar increases the interface area between the cable and the front closure member for enhancing the seal therebetween, and for stabilizing the position of the portion of the cable within the sleeve.

The space within the sleeve between the front closure member and the rear closure flange defines a sleeve chamber 32C for housing the connector nut and the terminal post after installation. A suitable moisture resistent material such as a gel or contact enhancement grease 32G may be provided within the sleeve chamber for protecting the connector nut and the terminal post, and for enhancing the rear seal, the front seal and the cable seal. The grease is displaced by the insertion of the front closure member during seating forcing-the grease into leak paths into the sleeve chamber. The grease is pushed into the rear closure seal interface, into the front seal closure interface, and into the helical interface along the nut-to-post engagement. Preferably, the front closure member is made of a suitable elastomeric material such as nylon or polyethylene which conforms to the shape of the sleeve in order to facilitate the displacement action of the front closure member.

Figure 4:
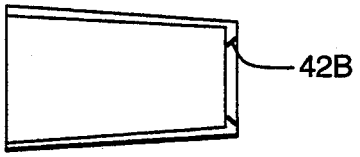
FIG. 4 is a side sectional view of a torque sleeve with a post aperture having a centering bevel.
Figure 5:
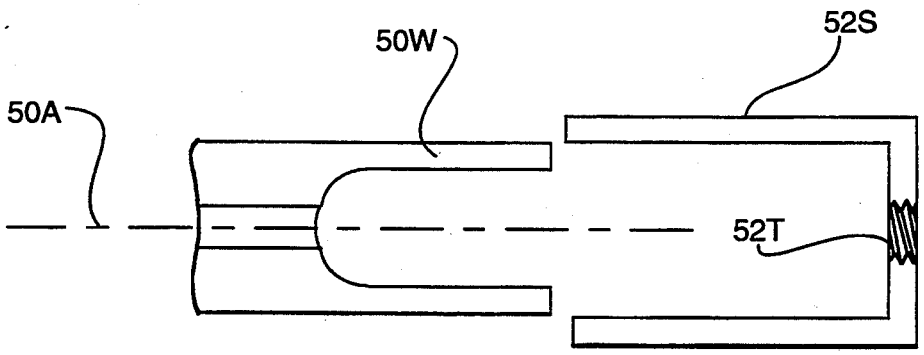
FIG. 5 is a side sectional view of a cylindrical torque sleeve with a post aperture having threads for engaging the terminal post threads.

POST APERTURE EMBODIMENTS (FIG. 4 and 5)

The post aperture may have a centering bevel 42B facing the terminal post for assisting installation onto the post terminal (see FIG. 4). In the embodiment of FIG. 4, the outside surface of the sleeve is cylindrical with a tapered inside surface.

The post aperture may have threads 52T (see FIG. 5) for engaging the treads of the terminal post. Alternatively, the post aperture may be self threading against the treads of the terminal post. The inside surface of sleeve member 52S and the outside surface of socket wrench 50W may be cylindrical and have a common central axis 50A when the sleeve is mounted which is coincident with the long axis of the body member. The diameter of the cylindrical sleeve may be slightly less than the diameter of the cylindrical wrench to establish the pre-loads in the sleeve and the wrench.

CABLE PASSAGE EMBODIMENTS (FIG. 6 ABC)

Figure 6A:
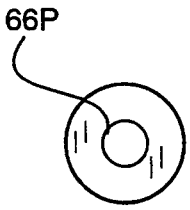
FIG. 6A is a front view of a front closure member with a central cable passage therethrough.

The cable passage may be a center hole 66P through the front closure member (see FIG. 6A) for permitting the cable to pass into the sleeve chamber. The cable is strung through the passage prior to being placed in cable channel 10C of body member 10B. After installation, the body member is removed and the front closure member is slipped forward to the end of the cable for seating into the sleeve.

Figure 6B:
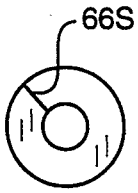
FIG. 6B is a front view of a front closure member with a side access split for positioning the closure member onto the cable.

Alternatively, the front closure member may have a side access split 66S (see FIG. 6B) extending therethrough to the cable passage for permitting placement of the front closure member onto the cable after the torque sleeve and cable have been installed onto the terminal post.

Figure 6C:
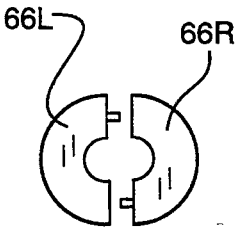
FIG. 6C is a front view of a two part front closure member with a cable passage therebetween.

The closure member may be formed by two identical cooperating parts 66L and 66R (see FIG. 6C) for permitting seating into the torque sleeve after the torque sleeve and cable have been installed onto the terminal post. The two parts are snapped together around the cable and inserted into the sleeve as an assembled unit. Alternatively, the two half parts may be seated sequentially for reducing the force required to seat the parts into the sleeve.

WRENCH GAP EMBODIMENTS (FIG. 7 ABC)

Figure 7A:
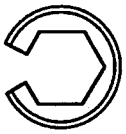
FIG. 7A is a front view of a socket wrench with a gap width slightly less then the diameter of the cable.
Figure 7B:
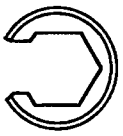
FIG. 7B is a front view of a socket wrench with a gap width slightly greater then the diameter of the cable.
Figure 7C:
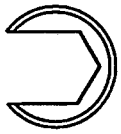
FIG. 7C is a front view of a socket wrench with a gap width equal to the diameter of the connector nut.

The side walls of the socket wrench have a gap therein formed by the cable channel. The width of the gap may be slightly less than the diameter of the cable (see FIG. 7A). The portion of the cable to be placed in the wrench is pinched slightly and pushed through the gap into the channel. The width of the gap may be greater than the diameter of the cable and less than the diameter of the connector nut (see FIG. 7B) permitting the cable to be easily placed in the wrench. The nut enters the wrench from the front to be captured by the wrench as the cable is pulled backward. The width of the gap may be equal to the diameter of the connector nut across the faces of the nut (see FIG. 7C) permitting the nut to enter the wrench from side as the cable is placed in the channel.

STRESS RISER EMBODIMENTS (FIG. 8 ABC)

Figure 8A:
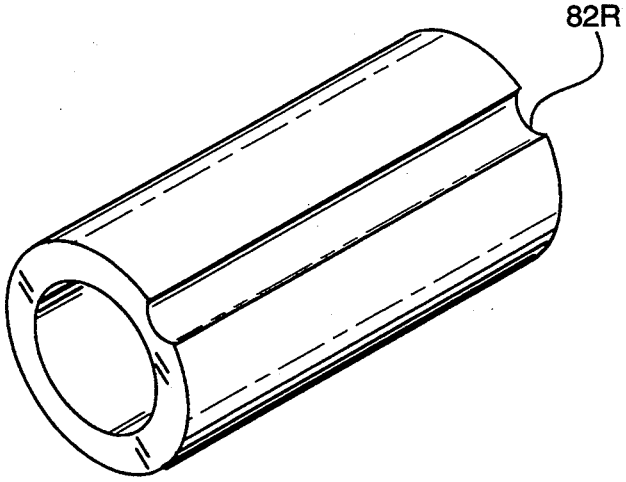
FIG. 8A is a perspective view of a torque sleeve having stress risers.
Figure 8B:
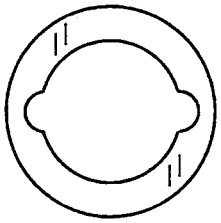
FIG. 8B is a sectional view of a torque sleeve with multiple stress risers.

A stress riser 82R may be formed in the torque sleeve for causing the rigid material of the sleeve to crack under the radial expansion created by the working load. The expansion cracks permit the side walls of the wrench to slip around the connector nut. Cracked sleeves are "used" and are no longer capable of developing a working load within the wrench. The location of the crack is defined by the position of the stress riser which is shown extending longitudinally in the embodiment of FIG. 8A. The stress riser may be formed along the outside of the sleeve or along the inside of the sleeve (see FIG. 8B). Multiple stress risers may be provided to facilitate breaking used sleeves away from the terminal post.

Alternatively, the stress riser may not crack but merely become "stress crazed" and change color indicating that the nut-to-post engagement has been torqued. Micro fissures form in the material of the stress riser due to the expansion, causing changes in the optical properties of the material.

SPECIFIC EMBODIMENT

The following particulars of the torque hand tool are given as an illustrative example.

Body Member 10B—5"(12.70 cm) long
Handle 10H length—2.25"(5.72 cm)
Handle diameter—1.5"(3.81 cm) diameter
Channel 10C—310 mils (0.79 cm) wide
Socket Wrench 10W—7/16"(1.11 cm) hexagon with a depth of ¾"(1.91 cm)
Sleeve Member 12S—400 mils (1.02 cm) long 650 mils (1.65 cm) inside diameter at large end 620 mils (1.57 cm) inside diameter at small end
Cable 14C—305 mils diameter cable (0.77 cm)
Connector Nut 14N—7/16"hexagon (1.11 cm) long
Terminal Post 14P—¼"(0.64 cm) long
Sleeve Color Code—four color set (red, blue, yellow and white)
Torque—10 inch-pounds The values given above are not intended as defining the limitations of the invention. Numerous other applications and configurations are possible.

INDUSTRIAL APPLICABILITY

It will be apparent to those skilled in the art that the objects of this invention have been achieved as described hereinbefore. Clearly various changes may be made in the structure and embodiments shown herein without departing from the concept of the invention. Further, features of the embodiments shown in the various Figures may be employed with the embodiments of the other Figures. Therefore, the scope of the invention is to be determined by the terminology of the following claims and the legal equivalents thereof.

I claim as my invention:

1. A hand tool for tightening a connector nut at the end of an electrical cable in order to install the cable onto a cable terminal post, comprising:

elongated body member having a long axis with a first end and a second end;

cable channel in the body member extending along the long axis of the body member from the first end to the second end, the cable channel having an end opening at each end of the body member for receiving the cable prior to the installation of the cable and for permitting the body member to turn relative to the cable during the installation of the cable and for removing the cable from the hand tool after the cable has been installed;

socket wrench means formed at the first end of the body member having an outside surface and an inside surface, the inside surface having side wall means for capturing the connector nut at the end of the electrical cable, the side wall means having a gap therein formed by the cable channel;

handle means formed at the second end of the body member for turning the wrench means and the connector nut captured therein without turning the cable, in order to thread the connector nut onto the terminal post and to tighten the connector nut against the terminal post; and a sleeve member having an outside surface and an inside surface, for slide mounting over the wrench means and the connector nut from the first end of the body member after the cable channel has received the cable and after the wrench means has captured the connector nut, the inside surface of the sleeve member engaging the outside surface of the wrench means for establishing a pre-load hoop tension in the sleeve member against the wrench means which establishes a pre-load compression in the wrench means against the connector nut.

2. The hand tool of claim 1, wherein the engagement between the inside surface of the sleeve member and the outside surface of the wrench member produces a working load hoop tension in the sleeve member as the nut is tightened against the terminal post, which produces a working load compression in the side wall means of the wrench against the nut.

3. The hand tool of claim 2, wherein the working load hoop tension has a critical value above which the tensile expansion of the sleeve member permits the wrench means to slip around the nut for limiting the torque of the nut against the terminal post.

4. The hand tool of claim 1, wherein the cable channel is coincident with the long axis of the elongated body member.

5. The hand tool of claim 1, wherein the width of the gap in the side wall means of the wrench means is slightly less than the diameter of the cable.

6. The hand tool of claim 1, wherein the width of the gap in the side wall means of the wrench means is greater than the diameter of the cable and less than the diameter of the connector nut.

7. The hand tool of claim 1, wherein the width of the gap in the side wall means of the wrench means is equal to the diameter of the connector nut across the faces of the nut.

8. The hand tool of claim 1, wherein the side wall means of the wrench means are longer than the faces of the connector nut, and form a socket deep enough to capture the entire length of the nut.

9. The hand tool of claim 1, further comprising an insert member positioned within the wrench means over the side wall means, formed of an abrasion resistant material.

10. A hand tool for tightening a connector nut at the end of an electrical cable in order to install the cable onto a cable terminal post, comprising:

elongated body member having a long axis with a first end and a second end;

cable channel in the body member extending along the long axis of the body member from the first end to the second end, the cable channel having an end opening at each end of the body member for receiving the cable prior to the installation the cable and for permitting the body member to turn relative to the cable during the installation of the cable and for removing the cable from the hand tool after the cable has been installed;

socket wrench means formed at the first end of the body member having an outside surface and an inside surface, the inside surface having side wall means for capturing the connector nut at the end of the electrical cable, the side wall means having a gap therein formed by the cable channel;

handle means formed at the second end of the body member for turning the wrench means and the connector nut captured therein without turning the cable, in order to thread the connector nut onto the terminal post and to tighten the connector nut against the terminal post;

a sleeve member having an outside surface and an inside surface, for slide mounting over the wrench means and the connector nut from the first end of the body member after the cable channel has received the cable and after the wrench means has captured the connector nut, the inside surface of the sleeve member engaging the outside surface of the wrench means for establishing a pre-load hoop tension in the sleeve member against the wrench means which establishes a pre-load compression in the wrench means against the connector nut; and the outside surface of the wrench means has a slight taper toward the first end of the body member, and the inside surface of the sleeve member has a slight taper generally matching the outside taper of the wrench means for causing the engagement of the matching tapers to increase as the sleeve member is slide mounted over the wrench means to establish the pre-load hoop tension in the sleeve member and the pre-load compression in the wrench means.

11. The hand tool of claim 10, wherein the outside surface of the wrench means has a shoulder means thereon which defines the maximum pre-load hoop tension within the sleeve member by limiting the slide mounting of the sleeve member.

12. The hand tool of claim 11, wherein the shoulder means is an annual rise extending around the wrench means proximate the bottom of the socket wrench means.

13. The hand tool of claim 10, wherein the wrench means and the sleeve member are slightly cone shaped for providing the matched tapers, and have a common central axis when engaged which is coincident with the long axis of the body member.

14. The hand tool of claim 10, wherein the slope of the matching tapers are high enough to provide the desired pre-load hoop tension in the sleeve member as the sleeve member is slide mounted on the wrench, and low enough to maintain static frictional engagement between the inside surface of the sleeve member and the outside surface of the wrench means.

15. The hand tool of claim 14, wherein the pre-load is sufficient to cause the side wall means of the wrench means to fit snugly against the connector nut for capturing the connector nut.

* * * * *